United States Patent [19]

Masaki

[11] 4,068,473

[45] Jan. 17, 1978

[54] AIR-FUEL MIXTURE DISTRIBUTION SYSTEM FOR MULTI-CYLINDER INTERNAL COMBUSTION ENGINE

[75] Inventor: Kenji Masaki, Yokohama, Japan

[73] Assignee: Nissan Motor Co., Ltd., Yokohama, Japan

[21] Appl. No.: 560,527

[22] Filed: Mar. 20, 1975

[30] Foreign Application Priority Data

Apr. 22, 1974 Japan ..... 49-45210

[51] Int. Cl.[2] ..... F01N 3/10; F02B 75/10

[52] U.S. Cl. ..... 60/282; 123/119 R

[58] Field of Search ..... 60/274, 276, 285, 282; 123/119 R, 127, 198 F, 32 EA, 139 AW, 140 MC

[56] References Cited

U.S. PATENT DOCUMENTS

| | | | |
|---|---|---|---|
| 3,745,768 | 7/1973 | Zechnall | 60/276 |
| 3,827,237 | 8/1974 | Linder | 60/285 |
| 3,890,946 | 6/1975 | Wahl | 60/276 |
| 3,910,240 | 10/1975 | Omori | 60/276 |

*Primary Examiner*—Douglas Hart

[57] ABSTRACT

A multi-cylinder engine is operated on air-fuel mixtures richer and leaner than stoichiometric during low load engine operation, and on the leaner mixture only during medium and high load operations.

3 Claims, 5 Drawing Figures

AIR-FUEL MIXTURE DISTRIBUTION SYSTEM FOR MULTI-CYLINDER INTERNAL COMBUSTION ENGINE

The present invention relates to an air-fuel mixture distribution system for a multi-cylinder internal combustion engine, which avoids noxious gas emissions throughout all phases of engine operation.

It is well known in the art that the highest concentration of nitrogen oxides in exhaust gases of an internal combustion engine results when the engine is operated on near an air-fuel mixture of stoichiometric air-to-fuel ratio. It is also well known that an afterburner for purifying the exhaust gases from the engine functions effectively by introducing and burning therein combustibles such as carbon monoxide and hydrocarbons in the form of unburned fuel. This results from supplying the combustion chambers with an air-fuel mixture far richer than the stoichiometric mixture.

In view of these tendencies, it has already been proposed that a multi-cylinder internal combustion engine is operated by supplying an air-fuel mixture far richer than stoichiometric into a certain number of cylinders and an air-fuel mixture far leaner than stiochiometric into the remaining cylinders, the latter mixture being employed for economy.

However, in the prior art, the multi-cylinder internal combustion engine will require two carburetors for feeding air-fuel mixtures far richer and leaner than stoichiometric mixtures respectively. This inevitably results in complex construction of its air induction system and fuel supply system. In addition, the air-fuel mixture far richer than stoichiometric will be unnecessarily supplied throughout all phases of engine operation even though not required. Furthermore, during medium and high load engine operations the afterburner is sufficiently heated and functions efficiently without additional supply of the far richer mixture.

It is, therefore, a main object of the present invention to provide an improved system which can supply, by using only one carburetor, an air-fuel mixture richer than stoichiometric into certain cylinders of a multi-cylinder internal combustion engine and an air-fuel mixture leaner than stoichiometric into the remaining cylinders.

It is another object of the present invention to provide an improved system capable of supplying the richer and leaner air-fuel mixtures into the engine during low load engine operation while supplying only the leaner air-fuel mixture thereinto during medium and high load engine operations.

Other objects and features of the improved system according to the present invention will become more apparent from the following description taken in conjunction with the accompanying drawings in which like reference numerals and characters designate corresponding parts and elements and in which.

Figure 1:
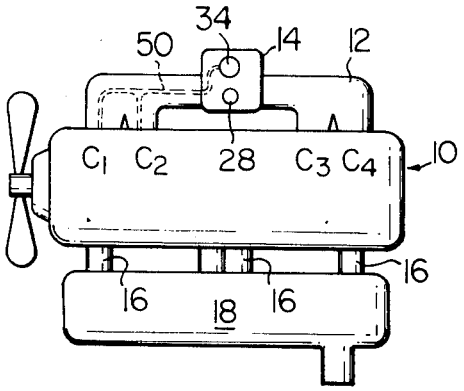
FIG. 1 is a schematic plan view showing a first preferred embodiment of the present invention in which a mixture enriching device is incorporated with a two-barrel carburetor.
Figure 2:
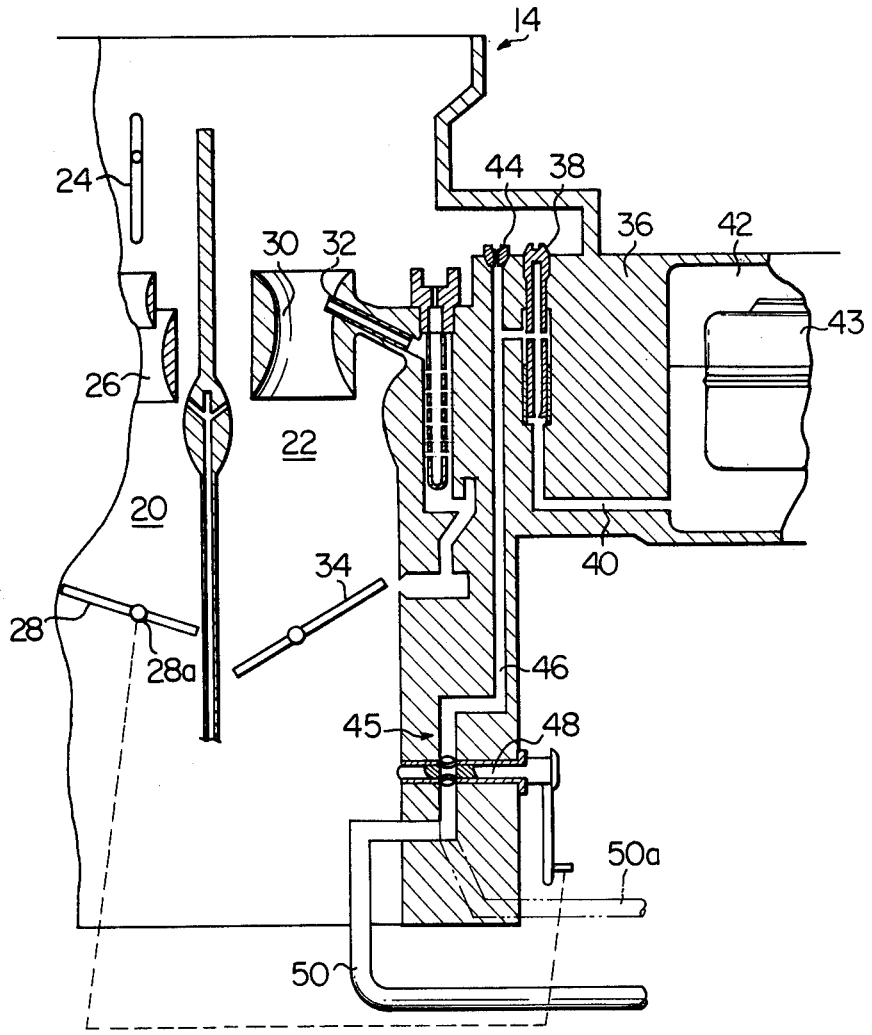
FIG. 2 is an enlarged schematic view of the carburetor shown in FIG. 1.

Referring now to drawings, first to FIGS. 1 and 2 there is shown a first preferred embodiment of the present invention in which a multi-cylinder internal combustion engine 10 is shown. The engine 10 has four cylinders $C_1$ to $C_4$ (only their locations shown). The intake ports (not shown) of the cylinders $C_1$ to $C_4$ communicate through an intake manifold 12 with a two-barrel carburetor 14 which is arranged to supply the cylinders with a first air-fuel mixture leaner than stoichiometric. The exhaust ports (not shown) of the cylinders $C_1$ to $C_4$ communicate through exhaust conduits 16 with means, such as an afterburner 18 for afterburning unburned constituents in the exhaust gases discharged from all the cylinders. As is well known in the art, the term "afterburner" is replaceable with a term "reactor" since the both are substantially the same.

An example of the two-barrel carburetor 14 is illustrated in detail in FIG. 2. As shown, the carburetor 14 comprises, as usual, the primary section 20 operative at low load engine operation and the secondary section 22 operative at medium and high load engine operations. The primary section 20 includes, as usual, a choke valve 24, a primary venturi 26 and a primary throttle valve 28. The secondary section 22 includes a secondary venturi 30 into which a main nozzle 32 opens, and a secondary throttle valve 34. The primary throttle valve 28 is rotatable by the accelerator pedal (not shown) through a suitable linkage. The secondary throttle valve 34 is rotatable by a primary valve shaft 28*a* through a delayed action linkage (not shown) which allows the primary throttle valve 28 to open before the secondary valve comes into operation, or by a springloaded disphragm (not shown) which is actuated by the primary venturi vacuum.

Disposed in the body casting portion 36 adjacent to the secondary section 22 of the carburetor 14 is a supplemental fuel jet 38 communicating through a fuel passage 40 with a fuel chamber 42 equipped with a float 42, the fuel jet 38 forming part of a mixture enriching device 45 according to the present invention. The fuel jet 38 is accompanied with an air bleed orifice 44 which mixes fuel from the fuel jet 38 with air. The fuel jet 38 and the orifice 44 communicate through an air fuel passage 46 with a flow control valve 48 such as a rotary valve. The flow control valve 48 is disposed through the lower wall of the body casting portion 36 and arranged to rotate and open proportionally with respect to the primary throttle valve 28 which is operated only during low load engine operation. A feed tube 50 communicates with the flow control valve 48 and extends through the induction passage of the carburetor 14 and along the intake manifold at a location upstream of the intake ports of the two cylinders $C_1$ and $C_2$. The feed tube is divided as indicated by a broken line in FIG. 1.

With this arrangement, during low load engine operation when the secondary throttle valve 34 still has not opened, the flow control valve 48 is opened proportionally with respect to the primary throttle valve 28 and allows supplemental fuel to flow from the fuel chamber 42. The supplemental fuel metered by the flow control valve 48 is sucked in and sprayed through the feed tube 50 into the first fuel air mixture passing through the portions upstream of the intake ports of the cylinders $C_1$ and $C_2$ by the high intake vacuum so that the first air-fuel mixture is enriched beyond the stoichiometric ratio. It will be noted that the second air-fuel mixture is produced by adjusting the size of the opening of the supplemental fuel jet 38 in addition to the above-mentioned enriching operation. This adjustment can be accomplished by manually inserting a tool in the slot, no reference number, at the top of the upper section, no reference number, of supplemental fuel jet 38 and moving the same axially with respect to its associated lower section, no reference number. Thus, the cylinders $C_1$ and $C_2$ are fed with the second air-fuel mixture and the remaining cylinders $C_3$ and $C_4$ are fed with the first air-fuel mixture during low load engine operation at which the secondary throttle valve 48 is still closed. Thus, during medium and high load engine operation when the secondary throttle valve 34 is opened, all the cylinders $C_1$ to $C_4$ are fed with the first air-fuel mixture even though the flow control valve 48 is fully opened in response to the fully opened primary throttle valve 28. This is because an intake vacuum sufficient to suck the supplemental fuel from the feed tube 50 can not be produced upstream of the intake ports of the cylinders $C_1$ and $C_2$ when the secondary throttle valve 34 is opened. While the supplemental fuel flow control valve 48 of this instance is operated in response to the primary throttle valve 28, the valve 48 may also be operated in response to engine speed, intake vacuum or the volume of air inducted.

Figure 3:
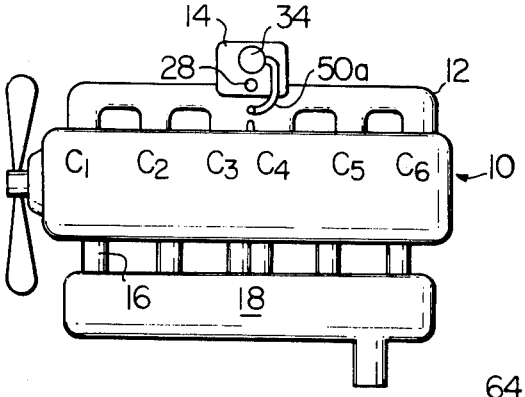
FIG. 3 is a schematic plan view similar to FIG. 1, but where a feed tube of the mixture enriching device extends via the outside of the carburetor into an intake manifold.

It will be noted that another feed tube 50*a* indicated in phantom in FIG. 2 may be used in the case where the feed tube needs to extend via the outside of the carburetor 14 as shown in FIG. 3. In FIG. 3, the engine 10 has six cylinders $C_1$ to $C_6$ (only their locations shown). The cylinders communicate through the intake manifold 12 with the two-barrel carburetor 14. The feed tube 50*a* is so disposed as to open into the bifurcate portion of the two manifold runners connecting the two cylinders $C_3$ and $C_4$. With this arrangement, during low load engine operation when the secondary throttle valve 34 still has not opened, the cylinders $C_1$, $C_2$, $C_5$ and $C_6$ are fed with the first air-fuel mixture and the cylinders $C_3$ and $C_4$ are fed with the second air-fuel mixture.

Figure 4:
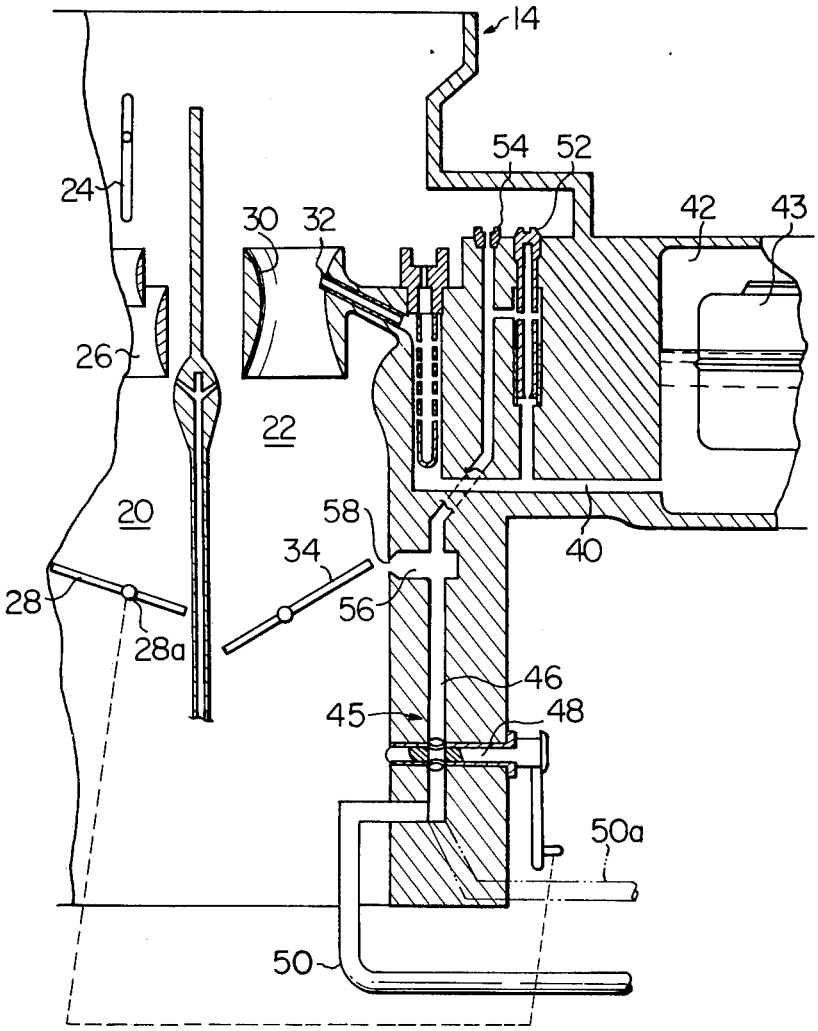
FIG. 4 is an enlarged schematic view of the carburetor of FIG. 2, but where the mixture enriching device is combined with a secondary progression system of the carburetor.

FIG. 4 illustrates another example of the two-barrel carburetor 14 which is similar to that in FIG. 2 except that jet 52 and an air bleed orifice 54 of the secondary progression system (no numeral) respectively serve as the supplemental fuel jet and the supplemental air bleed orifice of the mixture enriching device 45 of the present invention. As shown, the flow control valve 48 communicates the fuel-air passage 46 with a progression chamber 56 of the secondary progression system. The progression chamber 56 communicates through a progression hole 58 with the induction passage of the secondary section 22 of the carburetor 14. The term "progression" is used in the sense that when it is required to increase engine speed from the idle speed by opening the throttle valve slowly the progression hole 58 which is located above the edge of the fully closed positioned throttle valve 34, is uncovered to allow a regular increase in speed, without the occurence of a "flat-spot," i.e., irregular running during the change from idle to progression.

Figure 5:
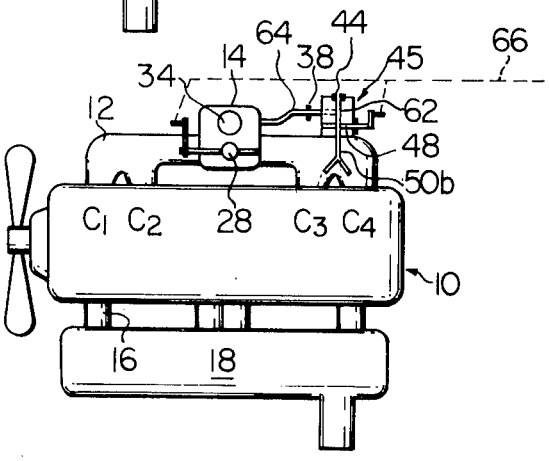
FIG. 5 is a schematic plan view showing a second preferred embodiment of the present invention in which the mixture enriching device is independently disposed from a two-barrel carburetor.

FIG. 5 illustrates a second preferred embodiment of the present invention which is similar to that in FIG. 1 with the exception that the mixture enriching device 45 is disposed outside of the carburetor 14. As shown, the mixture enriching device 45 includes the flow control valve 48 of rotary valve type which is mechanically connected to a linkage 66 for the throttle valves 28, 34 of the carburetor 14 to be operated with respect to the degree of opening of the primary throttle valve 28 of the two-barrel carburetor 14. The flow control valve 48 communicates through a passage 62 with the supplemental air bleed orifice 44. The passage 62 communicates through a fuel conduit 64 with the fuel chamber (not shown) of the carburetor 14. Disposed in the fuel conduit 64 is the adjustable supplemental fuel jet 38. The passage 62 communicates through the control valve 48 with the feed tube 50*b* which extends and opens into the manifold runners connecting cylinders $C_3$ and $C_4$ to the engine 10. Thus operation is similar to that of the arrangement shown in FIG. 1, where the cylinders $C_1$ and $C_2$ are fed with the first air-fuel mixture and the cylinders $C_3$ and $C_4$ are fed with the second air-fuel mixture during low load engine operation when the secondary throttle valve 34 of the carburetor still has not opened.

It will be understood that while a two-barrel carburetor has been shown and described, other types of carburetors such as single-barrel or four-barrel types may be similarly used.

As is apparent from the foregoing description, in accordance with the present invention, the engine 10 is not operated on a stoichiometric air-fuel mixture during any phase of engine operation, thus preventing excessive nitrogen oxides emissions therefrom. In addition, during low load engine operation, the engine 10 is operated on the air-fuel mixture richer and leaner than stoichiometric mixture so that exhaust gases containing relatively large amounts of unburned constituents are introduced into the afterburner 18 and therefore the afterburner 18 functions effectively. During medium and high load engine operations, the engine 10 is operated on the air-fuel mixture leaner than stoichiometric mixture, when the afterburner 18 functions effectively without relatively large amounts of the unburned constituents because of high temperature of exhaust gases introduced into the afterburner 18.

What is claimed is:

1. In a multi-cylinder internal combustion engine equipped with means for purifying exhaust gases discharged from all the cylinders, the system for supplying during low load engine operation a first air-fuel mixture leaner than stoichiometric mixture into predetermined cylinders and a second air-fuel mixture richer than stoichiometric mixture into the remaining cylinders, and during medium and high load engine operations the first air-fuel mixture into all the cylinders, comprising:

a carburetor for supplying the first air-fuel mixture into all the cylinders; and a mixture enriching device arranged to supply supplemental fuel from the fuel chamber of said carburetor into portions upstream of the intake ports of said remaining cylinders to enrich the first air-fuel mixture therethrough into the second air-fuel mixture, said mixture enriching device being arranged to supply the supplemental fuel in response to the engine load only during low load engine operation.

2. The system as claimed in claim 1, in which said mixture enriching device includes:

a supplemental fuel jet communicating with the fuel chamber of said carburetor;

a flow control valve communicating with said supplemental fuel jet and arranged to be operated in response to the degree of opening of a throttle valve of said carburetor;

a supplemental air bleed orifice disposed between said supplemental fuel jet and said flow control valve; and a feed tube communicating with said flow control valve and extending to the portions upstream of the intake ports of said remaining cylinders.

3. The system as claimed in claim 2, in which said flow control valve includes a rotary valve.

* * * * *